US009366059B2

(12) United States Patent
Müller et al.

(10) Patent No.: US 9,366,059 B2
(45) Date of Patent: Jun. 14, 2016

(54) OPERATING DEVICE WITH ELECTRONICS, AT LEAST PARTIALLY OPERATING AS A DYNAMIC BALANCER

(71) Applicant: Huf Hülsbeck & Fürst GmbH & Co. KG, Velbert (DE)

(72) Inventors: Ulrich Müller, Velbert (DE); Mirko Schindler, Velbert (DE)

(73) Assignee: HUF HULSBECK & FURST GMBH & CO. KG (DE)

( * ) Notice: Subject to any disclaimer, the term of this patent is extended or adjusted under 35 U.S.C. 154(b) by 589 days.

(21) Appl. No.: 13/651,539

(22) Filed: Oct. 15, 2012

(65) Prior Publication Data

US 2013/0147213 A1 Jun. 13, 2013

(30) Foreign Application Priority Data

Oct. 13, 2011 (DE) ..... 10 2011 054 470

(51) Int. Cl.

| | |
|---|---|
| ***E05B 3/00*** | (2006.01) |
| ***E05B 65/10*** | (2006.01) |
| ***E05B 77/06*** | (2014.01) |
| ***E05B 81/78*** | (2014.01) |

(52) U.S. Cl.

CPC ..... *E05B 65/108* (2013.01); *E05B 77/06* (2013.01); *E05B 81/77* (2013.01); *E05B 81/78* (2013.01); *Y10T 292/57* (2015.04)

(58) Field of Classification Search

CPC ..... E05B 65/108; E05B 77/06; E05B 81/77

See application file for complete search history.

(56) References Cited

U.S. PATENT DOCUMENTS

| | | | | |
|---|---|---|---|---|
| 3,719,248 | A | 3/1973 | Breitschwerdt et al. | |
| 2010/0237634 | A1 * | 9/2010 | Gandhi | 292/254 |
| 2011/0025522 | A1 * | 2/2011 | Peschl et al. | 340/686.6 |

FOREIGN PATENT DOCUMENTS

| | | | |
|---|---|---|---|
| DE | 102008054526 | A1 | 6/2010 |
| EP | 1900559 | A1 | 3/2008 |

OTHER PUBLICATIONS

Chinese Office Action issued Nov. 30, 2015 re: Application No. 2012103874643; pp. 1-10; citing: De 102008054526 A1.

* cited by examiner

*Primary Examiner* — Kristina Fulton
*Assistant Examiner* — Thomas Neubauer
(74) *Attorney, Agent, or Firm* — Cantor Colburn LLP

(57) ABSTRACT

An operating device for a locking device of a motor vehicle, including a movable handle on a door of the motor vehicle, a dynamic balancer that prevents the accelerations acting on the motor vehicle as a consequence of an accident from causing the handle to move out of the door, electronics that respond to the approach of a user and, in case of engagement, trigger a defined function of the locking device, where the electronics comprise a sensor element, integrated in the handle, and remaining electronics, which can be fastened at the inside of the door, with the remaining electronics acting at least partially as a the dynamic balancer.

9 Claims, 3 Drawing Sheets

OPERATING DEVICE WITH ELECTRONICS, AT LEAST PARTIALLY OPERATING AS A DYNAMIC BALANCER

TECHNICAL FIELD

The invention relates to an operating device for a locking device of a motor vehicle, comprising a movable handle on a door of the motor vehicle, a dynamic balancer that prevents the accelerations acting on the motor vehicle as a consequence of an accident from causing the handle to move out of the door, and electronics that respond to the approach of a user and, in case of engagement, trigger a defined function of the locking device.

BRIEF DESCRIPTION OF RELATED ART

DE 20 23 859 C3 discloses an operating device, which cooperates with a locking device of a motor vehicle. Here, the operating device comprises a movable handle, which can be operated by the user at the exterior of the motor vehicle door. At the interior, a dynamic balancer is provided, which is arranged at the inside of the motor vehicle door.

This dynamic balancer comprises a defined mass, which is additionally spring-loaded. In case of an accident, the dynamic balancer prevents the handle from moving out of the door due to the acceleration acting upon the vehicle.

It is known from DE 10 2011 053 472.5 for operating devices cooperating with a locking device of a motor vehicle to be provided with electronics, which communicate with an ID-generator carried by the user, or with the vehicle electronics. The ID-generator as well as the handle of the motor vehicle may be a part of a security system, particularly an access and/or driving authorization control system. For example, the security system may represent a keyless system, keyless-go system, in which the electronics of the vehicle communicate with the ID-generator. The operating device of the vehicle, particularly the exterior mounted handle, may be embodied with appropriate electronics, which allow data communication between the motor vehicle and the ID-generator. Due to the fact that these electronics are sensitive with regard to environmental influences—for example, soiling, moisture, etc.—here an appropriate sealing of the electronics occurs via a molding mass inserted into the handle. Here, the weight of the handle increases disadvantageously, particularly due to the additional material inserted by the molding mass and the electronics integrated in the handle. This leads to an increase of the mass in the dynamic balancer, in order to effectively prevent in case of an accident that the handle moves out of the door due to the mass inertia.

BRIEF SUMMARY

The invention provides an operating device for a locking device of a motor vehicle, in which the above-stated disadvantages are avoided, particularly in which an operating device is provided in which the weight of the dynamic balancer can be reduced and simultaneously it can be reliably ensured that in case of an accident the handle remains unmoved in its position at the door and thus any unintended opening of the door is prevented.

According to the invention it is provided that the electronics comprise a sensor element integrated in the handle and comprising remaining electronics, which can be fastened at the interior of the door, with the remaining electronics at least partially acting as a dynamic balancer.

According to the invention, only the sensor element is left inside the handle, with the remaining electronics being displaced into the area of the motor vehicle, located at the inside of the door. This means that the weight and/or the mass of the handle can be considerably reduced by the displacement of the remaining electronics into the door. Consequently the mass of the dynamic balancer can be reduced, in order to effectively keep the handle immobile in the door in case of an accident when accelerations act upon the motor vehicle, without here any risk arising that the door opens. According to the invention the sensor element may be embodied such that it is embodied as a capacitive sensor or as a Piezo sensor. This means that the electronics recognize an approach to the handle via the capacitive sensor or sense a contact of the handle by the Piezo sensor. Advantageously, the electronics with their sensor element and their remaining electronics are a part of the security system, particularly an access and/or driving authorization control system. For example, the security system may represent a keyless system, keyless-go system, in which the vehicular electronics communicate with the ID-generator carried by the user. It has been shown advantageously that the sensor element arranged in the handle is insensitive with regard to environmental influences, such as soiling, moisture, etc., so that it is not mandatory to provide the handle with a molding mass in order to effectively protect the electronics from environmental influences, as common in prior art. This way, the handle can be embodied free from molding mass, so that the mass of the handle can be further reduced. Particularly, the material of the molding mass contributes to the overall weight of the handle being high. Due to the embodiment of the handle according to the invention without any molding mass, it is contributed that the mass of the dynamic balancer can also be considerably reduced. Consequently, a compact, well operating handle can be provided, which requires only low weight in reference to the dynamic balancer.

Additionally, it is possible for a mobile coupling element to be provided at the inside of the door, which is in an effective connection to the handle, with particularly the remaining electronics being arranged at the coupling element. For example, the coupling element may be arranged rotational about an axis. When the user pulls at the handle, said handle moves out of the door and simultaneously the coupling element moves about its axis. For example, the coupling element may be spring-loaded so that the user must pull with a predetermined force at the coupling element in order to cause a movement of the handle out of the door. After the user has released the handle, the handle returns to its original position due to the influence of the spring force. According to the invention, the dynamic balancer, particularly the remaining electronics, may be arranged at the coupling element in order to counteract the mass inertia of the handle in case of an accident and thus prevents the door from opening unintentionally.

Additionally, the operating device may be embodied such that the dynamic balancer shows an additional mass, particularly fastened at the interior of the door in a detachable fashion. This means that in some applications the mass of the remaining electronics is insufficient for compensating the mass in order to effectively hold the handle immobile at the door in case of an accident. Accordingly, the dynamic balancer comprises the mass of the remaining electronics as well as the additional mass. The additional mass can be advantageously embodied from a metallic material.

Advantageously, the remaining electronics may be integrated in the additional mass. This means that the additional mass, together with the remaining electronics, forms a uniform and/or joint component, which for example can be arranged at the coupling element. This additional mass may be embodied metallic, where particularly the additional mass may comprise a fastening element in order to reliably fasten the remaining electronics at the additional mass. Additionally, it is possible for the additional mass to comprise a cavity in which the remaining electronics are located. Advantageously, the cavity can be closed by a cover element in order to reliably protect the remaining electronics from environmental influences.

In another improved measure according to the invention, the handle may show a hollow chamber, by which the mass of the exterior handle can be considerably reduced. Advantageously, the handle is made from a plastic material. This weight reduction or mass reduction of the handle shows the positive consequence that here the mass of the dynamic balancer can also be considerably reduced.

Additionally, the invention may comprise a support frame, at which both the handle and the coupling element are supported in a movable fashion. The support frame can be fastened at the inside of the door of the motor vehicle. Furthermore, it may be provided that a first arm is provided at the handle, which arm penetrates through the chassis of the door and engages the movable coupling element in order for the coupling element to be moved accordingly about its axis when the handle is operated. Further, the support frame provides a support point for the handle, which extends with a second arm through the chassis of the door into the interior area and is here supported in a movable fashion at the support point of the support frame. Advantageously, a transmission element may be arranged at the coupling element, which transmission element can be connected to the locking device of the motor vehicle. Here, the locking device is a component of the security system, which may comprise an access and/or driving authorization control system. For example, it is possible that the transmission element is embodied as a Bowden cable, connecting the coupling element to a lock of the locking device arranged at the door of the motor vehicle. Accordingly, the lock of the locking device is mechanically connected to the coupling element or the handle. Additionally, in an alternative embodiment of the invention, it is provided that the lock is electronically connected to the handle or the coupling element.

In a measure improving the invention, it may be provided that the dynamic balancer is arranged at the transmission element. The dynamic balancer may be integrated at the Bowden cable, for example. It is particularly advantageous that the dynamic balancer does not act indirectly on the Bowden cable via other components.

According to the invention, the sensor element located at the exterior handle may be connected via a line to the remaining electronics. Additionally, it may be provided that the remaining electronics can be capacitively coupled to the sensor element. For example, the remaining electronics may show a first electrode in an area of the handle which can be arranged at the inside of the door. The second electrode is located distanced from the first electrode at an interior component of the door or the operating device. For example, the second electrode may be arranged at and/or in the support frame and/or the coupling element. An air gap exists between the first electrode and the second electrode. The second electrode is electrically connected to the remaining electronics, for example via a line. In the normal position of the operating device, particularly the handle, an electric coupling field may develop between the first and the second electrode, by which the sensor element can transmit signals to the remaining electronics. The first electrode and the second electrode are advantageously integrated in the handle and/or in the support frame and/or in the coupling element. Advantageously, the handle forms a monolithic component with the sensor element and/or the first electrode, with the handle representing an injection molded plastic part and the sensor element and the first electrode serving for a capacitive coupling to the remaining electronics being coated, at least partially, by an injection molded plastic cover. The second electrode communicating with the first electrode may also be integrated with the support frame and/or the coupling element and/or another component arranged fixed inside the door by way of an injection molding process. Advantageously, electronic lines between the movable handle and the remaining electronics arranged inside the vehicle door can be waived.

Furthermore, it may be provided that the coupling element and/or the transmission element comprise a fastening means, at which the dynamic balancer, particularly the additional mass and/or the remaining electronics are fastened. Here, it is possible that the dynamic balancer can be fastened via a clip connection and/or a snap connection at the coupling element and/or the transmission element in an easily assembled fashion. Additionally, the fastening means may be embodied as an accept, in which the dynamic balancer can be fastened, particularly the additional mass and/or the remaining electronics, in a form- and/or force-fitting fashion and/or a material-to-material manner.

In a potential embodiment of the invention, a container may be provided in which the remaining electronics and/or the additional mass is/are arranged, with particularly the remaining electronics being sealed by a molding mass. The container therefore reliably accepts the remaining electronics and/or the additional mass. Here, the container may be fastened at the fastening means of the coupling element and/or the transmission element. The container itself may be embodied from an appropriate mass, so that the container forms the additional mass and simultaneously creates a cavity for the remaining electronics. The container may be closed via a cover element. Additionally, it is possible for the container to be fastened detachably at the coupling element and/or the transmission element. This way it is possible that the remaining electronics and/or the additional mass may be interchangeable depending on the application. In order to increase the seal of the remaining electronics inside the container, a molding mass may be inserted into the container, surrounding the remaining electronics. This ensures a reliable protection of the remaining electronics from environmental influences. The molding mass serves as an additional mass for the dynamic balancer.

Advantageously, the fastening means may be embodied such that the dynamic balancer is interchangeable, with particularly the interchangeable dynamic balancers showing different masses and/or geometries. This way, a homogenization of at least a certain number of components of the operating device can be yielded. The components of the operating device located at the interior, such as the support frame, coupling element, transmission element, fastening means, etc., may be embodied uniformly, independent of the model of the handle, with only the mass of the dynamic balancer needing to be adjusted depending on the mass of the handle. This means that an appropriate dynamic balancer must be selected for a handle with a greater mass, which in a potential accident reliably counteracts any motion of the handle out of the door due to its inertia. For example, it may be provided that the dynamic balancer may be embodied cylindrically and the mass may be adjusted via the length of the cylinder. Alternative geometries of the dynamic balancer are also possible. The fastening means and/or its accept are advantageously adjusted to the geometry of the dynamic balancer, in order to ensure reliable fastening.

According to the invention, the sensor element may represent an electrode and/or the sensor element may be embodied as a capacitive sensor or as a Piezo sensor. Here, the electrode may be integrated in the wall of the handle. Advantageously, the handle comprises a hollow chamber by which the weight of the handle can be reduced. The capacitive sensor or the Piezo sensor may also be provided in the wall and/or at the wall of the handle.

BRIEF DESCRIPTION OF THE DRAWINGS

Additional advantages, features, and details of the invention are discernible from the following description, with several exemplary embodiments of the invention being described in detail with reference to the drawings. Here, the features mentioned in the claims and in the description may be essential for the invention, each individually or in any arbitrary combination. In the figures:

DETAILED DESCRIPTION

Figure 1:
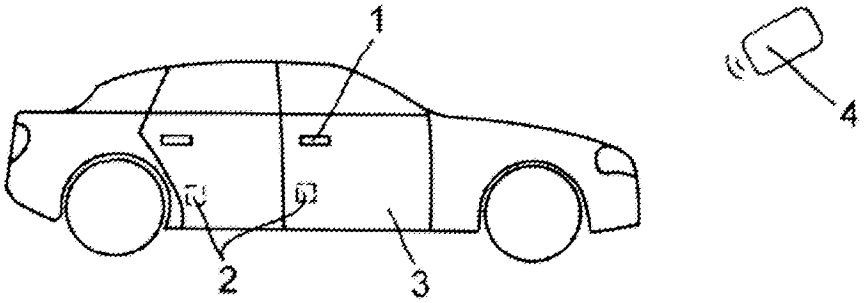
FIG. 1 shows a schematic view of a motor vehicle with an operating device according to the invention.

FIG. 1 schematically shows a motor vehicle, comprising at its door 3 an operating device 1 to be operated by the user from the outside. The operating device 1 is a component of a security system, particularly an access control system and/or a driving authorization control system. As schematically shown in FIG. 1, the door 3 comprises a lock 2, which can be addressed via a defined activation at the operating device 1. Depending on the respective application, a locking and/or unlocking can be triggered by the lock 2 via an approach and/or contact of the operating device 1. It is also possible that via an appropriate active pulling at the operating device 1 the lock 2 can be activated and moved such that an opening process of the door 3 can be realized and the user of the motor vehicle can enter it.

Figure 2:
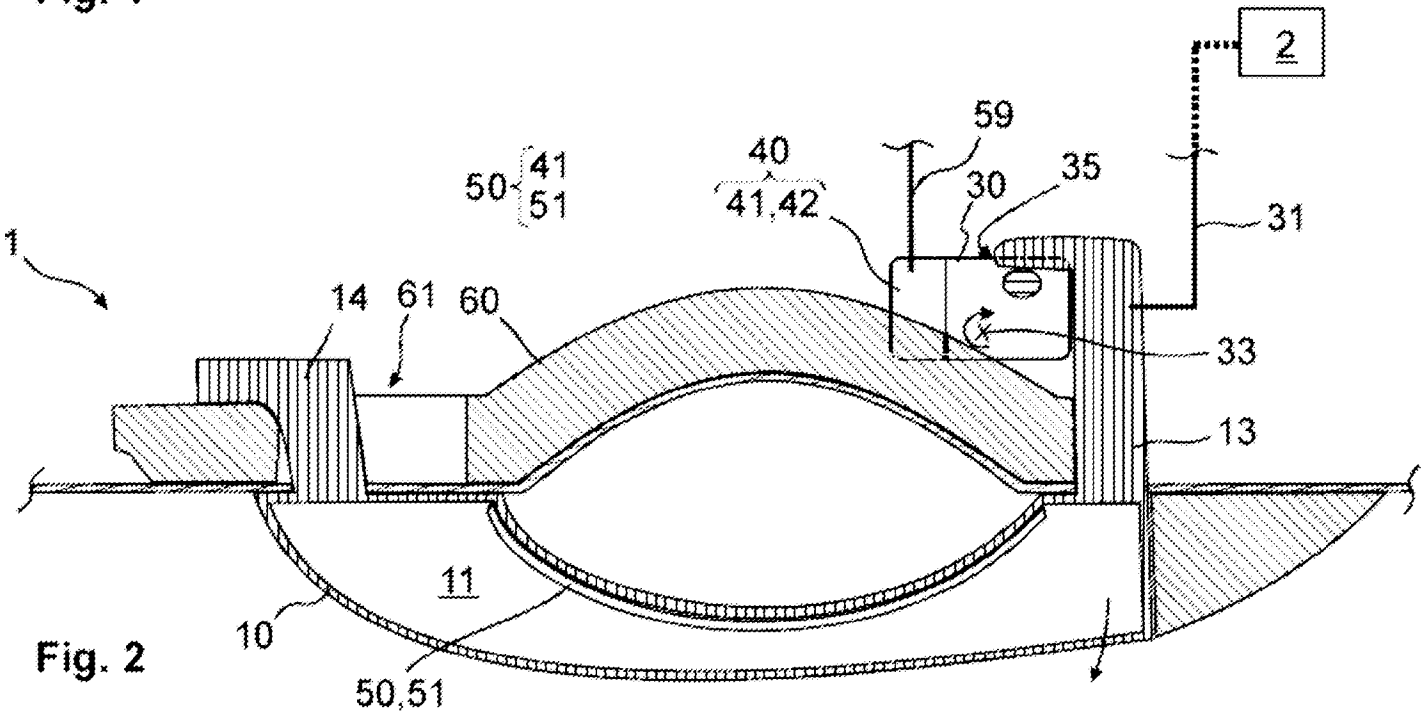
FIG. 2 shows a schematic cross-section of an operating device according to FIG. 1.

FIG. 2 shows a potential example of an operating device 1, which can be used in FIG. 1. As already mentioned, the operating device 1 is a component of a security system, particularly a locking device of a motor vehicle, with the locking device comprising the lock 2. The security system may additionally comprise an ID-generator 4, carried by the user (see FIG. 1). In order to allow only the authorized person to enter the motor vehicle, an identification check occurs between the ID-generator 4 and the motor vehicle, which may be coded. An essential component of the invention comprises that a sensor element 51 is arranged inside the handle 10 of the operating device 1, which detects the user approaching. Here, approaching shall be understood such that the sensor element 51, for example, recognizes and detects a contacting of the handle 10. Additionally the invention includes that a mere approaching, without the handle 10 actually being contacted, can be sensed via the sensor element 51. For example, the sensor element 51 may here be embodied as an electrode. Additionally, it is possible that the sensor element 51 according to FIG. 2 is embodied as a capacitive sensor or as a Piezo sensor. In the present exemplary embodiment according to FIG. 2, the sensor element 51 is arranged at the side of the handle 10 facing the door 3. An alternative arrangement of the sensor element 51 at the handle 10 is also possible, for example at the side of the handle 10 facing away from the door 3.

The handle 10 shown in FIG. 2 comprises a hollow chamber 11, by which the mass of the handle 10 is reduced. The sensor element 51 is a component of electronics 50, which comprises remaining electronics 41. Here, the sensor element 51 is in a signaling connection with the remaining electronics 41, with the sensor element 51 and the remaining electronics 41 being distanced from each other. The remaining electronics 41 are shown schematically in all exemplary embodiments. For example, the remaining electronics 41 show a printed circuit board, which can accept the signals of the sensor element 51, and in particular "process" them further. As shown in FIG. 2, a line 59 is provided which connects the remaining electronics 41 with the on-board electronics of the motor vehicle, not shown explicitly.

Figure 3:
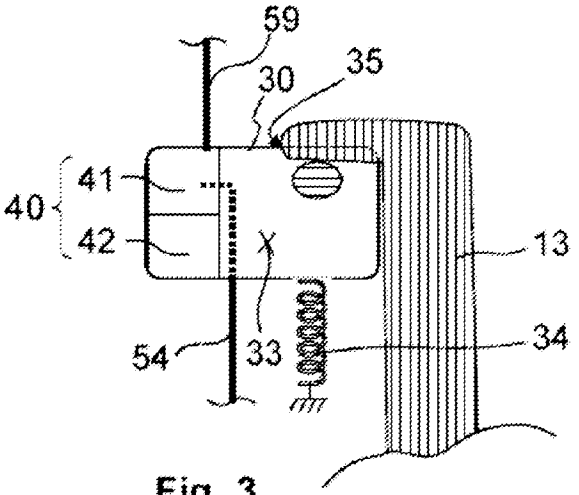
FIG. 3 shows a potential exemplary embodiment of another alternative of an operating device according to FIG. 2.

The operating device 1 comprises a dynamic balancer 40, which prevents accelerations acting upon the vehicle as a consequence of an accident from causing the handle 10 to move out of the door 3. It has been shown that in accidents, particularly lateral accelerations act upon the handle 10 such that an unintentional opening of the door 3 may be triggered. In order to prevent this, the above-mentioned dynamic balancer 40 is used, which acts upon the first arm 13 of the handle 10, which shall be discussed in the following. The handle 10 further comprises a second arm 14, with both arms 13, 14 extending in the interior of the door 3. In the interior of the door 3, the operating device 1 shows a support frame 60, which, among other things, offers a support point 61 for the second arm 14. When the user pulls at the handle 10, the handle 10 is pivoted at the support point 61 in the clockwise direction. Simultaneously, the first arm 13 of the handle 10 is entrained. As schematically shown in FIGS. 2 through 6, the first arm 13 of the handle 10 is in an effective connection to a spring-loaded coupling element 30. The coupling element 30 is supported pivotally about an axis 33. In the present exemplary embodiment, the support frame 30 is embodied with the respective axis 33 in order to allow for the coupling element 30 to move when the user pulls at the handle 10. In order to allow the handle 10 to automatically return into its original position according to FIG. 2, a spring 34 engages the coupling element 30 (see example: FIG. 3), ensuring that the handle 10 reliably returns into its normal position when the user no longer engages the handle 10.

A defined addressing of the locking device, particularly the lock 2, occurs by moving the first arm 13. For example, the first arm 13 may be connected mechanically to the lock 2. The connection may, for example, be realized by a Bowden cable 31. Additionally, it may be provided that via a motion of the handle 10 as well as the first arm 13 a signal is transmitted to the locking device or the lock 2, so that the lock performs a defined function, particularly is unlocked.

In case of an accident, particularly in case of a lateral impact of the motor vehicle, the handle 10 attempts to move out of the door 3 due to its inertia. The dynamic balancer 40, arranged at the door 3, prevents this in the following manner: here, the dynamic balancer 40 comprises the remaining electronics 41; this means the remaining electronics 41 are a component of the dynamic balancer 40. According to FIG. 2, the dynamic balancer 40 is integrated at the movable coupling element 30. In case of an accident, the dynamic balancer 40 attempts to move about the axis 33 in the counterclockwise direction. The force of the dynamic balancer 40 acts upon the first arm 13 and is greater than the force attempting to move the handle 10 out of the door 3 in the event of an accident. As discernible in FIG. 2, the coupling element 30 comprises an accept 35, in which at least partially the first arm 13 is held in a form-fitting fashion or in which the arm 13 may act. Depending on the application, it may also be provided that the mass of the dynamic balancer 40 is essentially determined by the remaining electronics 41 as well as the movable coupling element 30. If necessary, the exemplary embodiment shown in FIG. 2 may be modified such that the dynamic balancer 40 additionally comprises an additional mass 42 at the coupling element 30, in order to effectively prevent the handle 10 from moving out of the door 3 in case of a potential crash.

In the present exemplary embodiment according to FIG. 2, the handle 10 is embodied with a hollow chamber 11 and thus shows a lower self-weight. Accordingly, only a low mass is necessary with regards to the dynamic balancer 40. Consequently, the operating device 1 can be reduced in its overall weight. Due to the fact that the sensor element 51 is more or less insensitive with regards to environmental influences, in the given exemplary embodiment it is not necessarily mandatory for the sensor element 51 to be sealed with a molding mass inside the handle 10. Waiving the molding mass also contributes to the reduction of the overall weight of the operating device 1.

Figure 8:
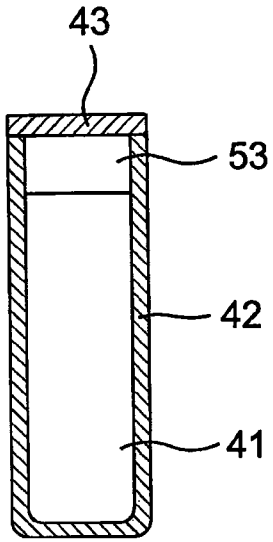
FIG. 8 shows another exemplary embodiment of a dynamic balancer, which can be used according to FIG. 2.

The dynamic balancer 40, particularly the remaining electronics 41 and/or the additional mass 42, may be fastened at the coupling element 30 in a form- and/or force-fitting and/or material-to-material fashion. It is particularly beneficial for the assembly to fasten the dynamic balancer 40 via a snap connection and/or clip connection at the coupling element 30. For example, it is possible for the remaining electronics 41 to be arranged at the coupling element 30 separated from the dynamic balancer 42. This means that the remaining electronics 41 are fixated at the coupling element 30 at a distance from the additional mass 42. The additional mass 42 may also be integrated in the coupling element 30. It is also possible for the additional mass 42 to be embodied as a cavity according to FIG. 8, with the remaining electronics 41 being inserted into the cavity. Any sealing of the remaining electronics 41 occurs via the cover 43, which due to its mass also serves as a dynamic balancer.

FIG. 3 shows schematically that the coupling element 30 may comprise the remaining electronics 41 and, in another exemplary embodiment, additionally also the additional mass 42, in order to provide the respective dynamic balancer 40 for the handle 10 in case of a crash.

Figure 4:
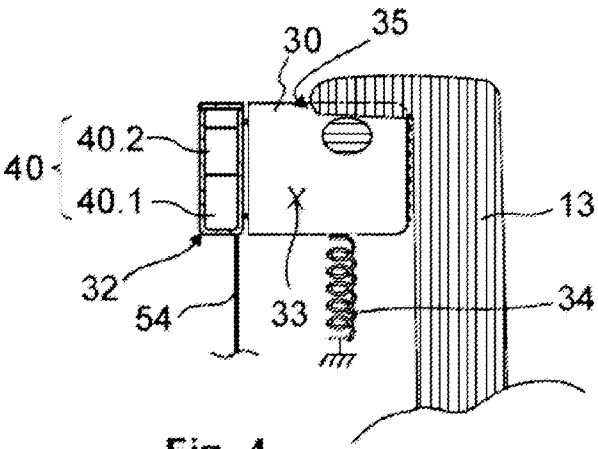
FIG. 4 shows another schematic view of an exemplary embodiment of an operating device according to FIG. 2.

FIG. 4 shows as an example that the dynamic balancer 40 may be arranged at a fastening means 32 of the coupling element 30. The fastening means 32 comprises an accept 32, in which the dynamic balancer 40 with its remaining electronics 41 and perhaps the additional mass 42 may be placed and inserted. The geometric embodiment of the dynamic balancer 40 is essentially adjusted to the geometry of the accept 32, so that the dynamic balancer 40 can be assembled or disassembled in the accept 32 in an easy fashion.

According to FIG. 4, it is particularly advantageous that the accept 32 is embodied such that the dynamic balancer 40 is interchangeable. Here, it is particularly advantageous that depending on the respective requirements with regard to the operating device 1, different masses and/or geometries of the dynamic balancer 40 can be accepted by the fastening means 32. As indicated in FIG. 4, it is possible to insert a dynamic balancer 40.1 into the fastening means 32. Alternatively, a larger dynamic balancer 40.2 can be inserted into the fastening means 32. This variable application of dynamic balancers 40, different in their geometries, creates advantageous degrees of freedom for the production of the operating device 1.

Figure 7:
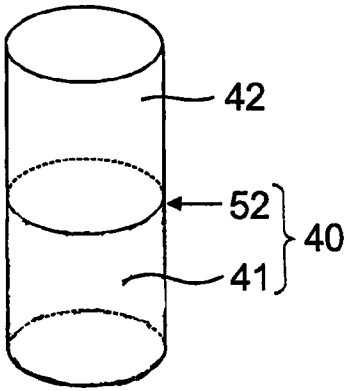
FIG. 7 shows another exemplary embodiment of a dynamic balancer, which can be used according to FIG. 2.

FIG. 7 shows a container 52, in which the remaining electronics 41 are arranged. The container 52 with the remaining electronics 41 forms the dynamic balancer 40, which in case of an accident prevents the handle 10 from moving out of the door 3. The container 52 may be embodied from a plastic, for example. It is also possible that in addition to the remaining electronics 41 an additional mass 42 is inserted in the container 52, in order to increase the mass of the dynamic balancer 40. Additionally, it is possible to seal the remaining electronics 41 according to FIG. 7 and/or FIG. 8 with a molding mass 53.

Figure 5:
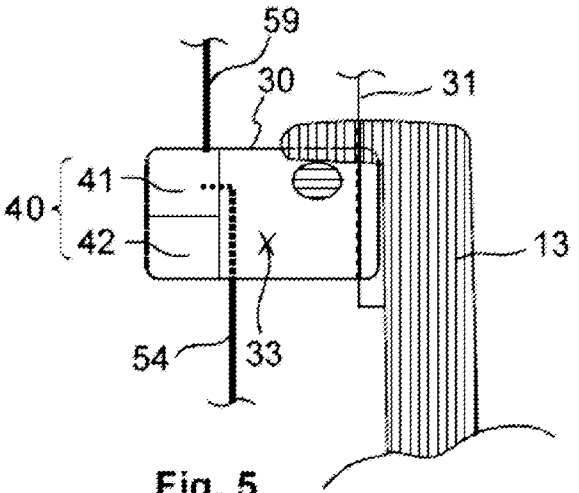
FIG. 5 shows another embodiment of a potential embodiment of an operating device according to FIG. 2.

According to FIG. 5, another exemplary embodiment is shown, which allows a fastening of the dynamic balancer 40 at the Bowden cable 31. In FIG. 5 the dynamic balancer 40 is also pivotal about the axis 33. Simultaneously, the Bowden cable 31 is connected fixed to the dynamic balancer 40, with the Bowden cable 31 being connected to the lock of the door 3, not explicitly shown.

Figure 6:
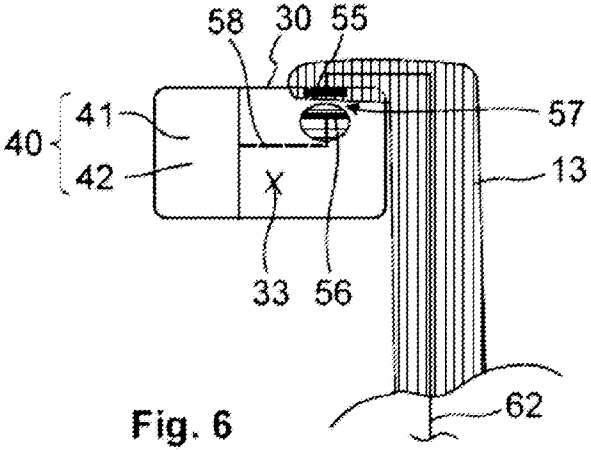
FIG. 6 shows another alternative of an embodiment of an operating device according to FIG. 2.

According to FIGS. 2 through 5, the sensor element 51 is connected via a line 54 to the remaining electronics 41. The on-board electronics may be in contact via a line 59 with the remaining electronics 41. FIG. 6 shows another alternative in which the remaining electronics 41 are capacitively coupled to the sensor element 51. Here, the first arm 13 shows a first electrode 55. Furthermore, the first electrode 55 is connected via a line 62 to the sensor element 51. A second electrode 56 is provided at the side of the coupling element, connected via a line 58 to the remaining electronics 41. In FIG. 6, too, the coupling element 30 is supported rotationally via the axis 33. There is a gap 57 between the first electrode 55 and the second electrode 56. A signal transmission between the sensor element 51 and the remaining electronics 41 may occur via a developing coupling field between the first electrode 55 and the second electrode 56.

In another alternative embodiment, it is possible for the electric connection to occur between the remaining electronics 41 and the on-board electronics via the schematically shown axis 33. A capacitive coupling is also possible between the remaining electronics 41 and the on-board electronics, with here an electrode being necessary which is located at the dynamic balancer and another electrode being arranged at a component distanced from the dynamic balancer, with a coupling field forming between the two electrodes, and thus signal transmission is possible from the remaining electronics to the on-board network and/or vice versa.

The invention claimed is:

1. An operating device for a locking device of a motor vehicle, comprising a movable handle on a door of the motor vehicle, the door having a first arm, a dynamic balancer integrated at a coupling element is configured to prevent the accelerations acting on the motor vehicle as a consequence of an accident from causing the handle to move out of the door, wherein the dynamic balancer moves about an axis of the coupling element and the dynamic balancer includes a first force acting on the first arm, the first force being larger than a second force acting on the handle, an electronics system that responds to the approach of a user and, in case of engagement, triggers a defined function of the locking device, wherein the electronics system comprises a sensor element that is integrated in the handle, and an electronics component fastened at the inside of the door, with the electronics component acting at least partially as a dynamic balancer, wherein the electronics component or a mass are disposed in a container.

2. An operating device according to claim 1, wherein a movable coupling element is provided at the inside of the door, which is in an effective connection with the handle, with the electronics component being arranged at the coupling element.

3. An operating device according to claim 1, wherein the dynamic balancer comprises a mass fastened detachably at the inside of the door.

4. An operating device according to claim 3, wherein the electronics component is integrated in the mass.

5. An operating device according to claim 1, wherein the handle is embodied free from molding mass and/or the handle comprises a hollow chamber.

6. An operating device according to claim 1, wherein a support frame is provided, on which the handle as well as the coupling element are supported in a movable fashion, with a transmission element being arranged at the coupling element, which is connected to a locking device.

7. An operating device according to claim 6, wherein the dynamic balancer is arranged at the transmission element.

8. An operating device according to claim 1, wherein the coupling element and/or the transmission element comprises a fastening element at which the dynamic balancer, comprising the mass and/or the electronics component, is fastened.

9. An operating device according to claim 1, wherein the sensor element is an electrode and/or the sensor element is embodied as a capacitive sensor or as a Piezo sensor.

* * * * *